United States Patent [19]

Eichler et al.

[11] 4,208,965

[45] Jun. 24, 1980

[54] METHOD FOR ELECTROSTATIC ASSISTANCE IN PRINTING PROCESSES, AND PRINTING MACHINES HAVING ELECTROSTATIC SUBSTRATE CONTACT PRESSURE

[76] Inventors: Helmut Eichler, Burgunderstr. 13, D-7601 Durbach; Franz Knopf, Meister-Erwinstr. 18a, D-758 Bühl, both of Fed. Rep. of Germany

[21] Appl. No.: 889,801

[22] Filed: Mar. 24, 1978

[30] Foreign Application Priority Data

Mar. 25, 1977 [DE] Fed. Rep. of Germany ..... 2713334
Apr. 7, 1977 [DE] Fed. Rep. of Germany ..... 2715766

[51] Int. Cl.[2] ..... B41F 5/04; G05F 1/00

[52] U.S. Cl. ..... 101/426; 346/155; 355/3 R; 250/324; 101/153; 101/DIG. 13; 315/307

[58] Field of Search ..... 101/426, 219, DIG. 13, 101/216, 153; 346/153, 155; 250/324, 325; 315/291, 307; 355/3 R, 3 TR

[56] References Cited

U.S. PATENT DOCUMENTS

| | | | |
|---|---|---|---|
| 3,083,121 | 3/1963 | Gauthier | 101/DIG. 13 |
| 3,295,441 | 1/1967 | Garnier | 101/DIG. 13 |
| 3,370,529 | 2/1968 | Michalchik | 101/DIG. 13 |
| 3,411,932 | 11/1968 | Malone et al. | 101/DIG. 13 |
| 3,604,925 | 9/1971 | Snelling | 315/291 X |
| 3,619,720 | 11/1971 | Coberley | 101/153 X |
| 3,623,123 | 11/1971 | Jvirblis | 101/DIG. 13 X |
| 3,661,081 | 5/1972 | Wright | 101/426 |
| 3,812,780 | 5/1974 | Borelli | 101/216 |
| 4,105,320 | 8/1978 | Bean | 355/3 TR |

FOREIGN PATENT DOCUMENTS

| | | | |
|---|---|---|---|
| 1611204 | 11/1967 | Fed. Rep. of Germany | 101/DIG. 13 |
| 1159923 | 7/1969 | United Kingdom | 101/DIG. 13 |
| 1349342 | 4/1974 | United Kingdom | 101/DIG. 13 |

*Primary Examiner*—E. H. Eickholt
*Attorney, Agent, or Firm*—Sughrue, Rothwell, Mion, Zinn and Macpeak

[57] ABSTRACT

A method for electrostatic assistance of the printing process in printing machines, in which method a printing substrate, being of a material which is not electrically conductive, is passed between a printing cylinder coated with printing ink and a contact pressure roller which mechanically presses the substrate against the cylinder and which is provided with a non-conductive or weakly-conductive outer layer, during which procedure the application of a high voltage between the printing cylinder and at least one of the electrode arrangements running in a longitudinal direction to the contact pressure roller results in electrons and ions being sprayed by corona discharge onto the surface of the contact pressure roller, which, as a result of its rotating and/or its intrinsic conductivity conveys these charged particles into the printing gap and enables them to flow off over this gap, and also a corresponding printing machine.

29 Claims, 4 Drawing Figures

1
2
3
4
5
6
7
8
9
10
11
12
13
14
15
16
18
18'
26
27
28
29
30
A
B
C
D
E
H

Fig. 2
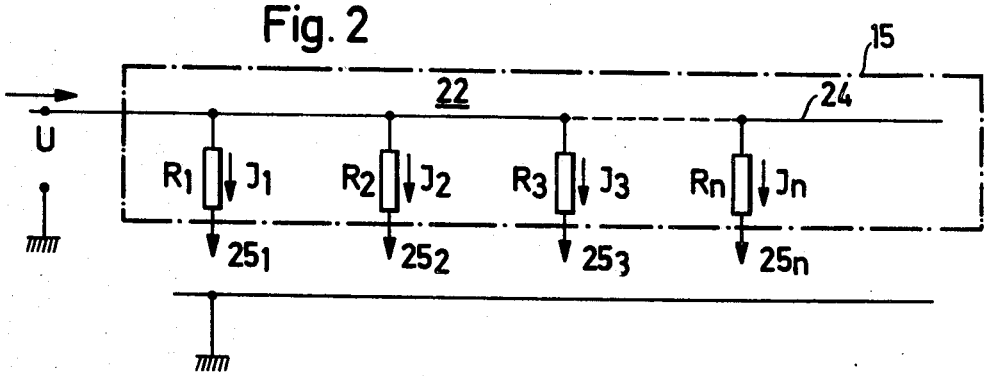
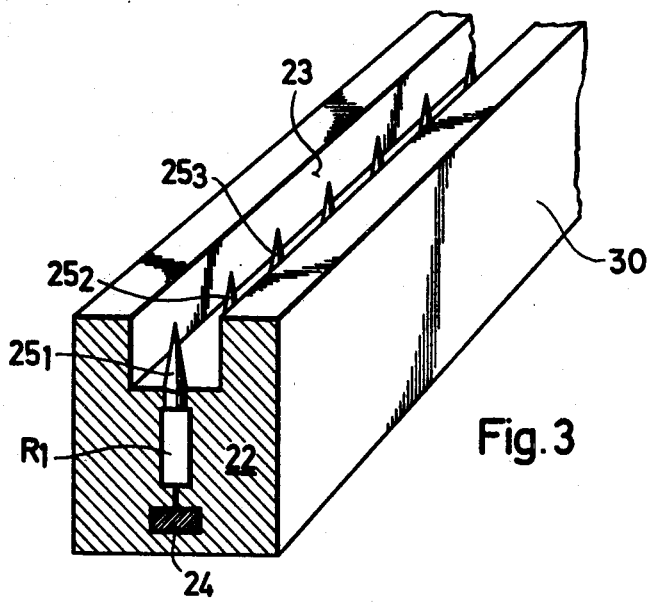
Fig. 3
Fig. 4
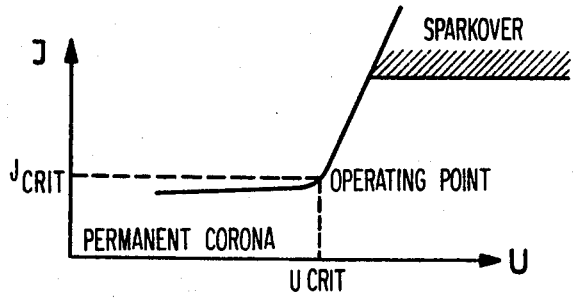

METHOD FOR ELECTROSTATIC ASSISTANCE IN PRINTING PROCESSES, AND PRINTING MACHINES HAVING ELECTROSTATIC SUBSTRATE CONTACT PRESSURE

BACKGROUND OF THE INVENTION

1. Field of the Invention

This invention relates to a method for electrostatic assistance in printing processes, and printing machines having electrostatic substrate contact pressure.

2. Description of the Prior Art

It has been known for a long time that an electrostatically charged foil being of material which is not electrically conductive is drawn onto a surface having an oppositely polarized charge until the charge has been equalized. The present invention makes use of this physical effect in order to press a printing substrate—eg. a sheet or strip of paper, plastic or textile material—firmly and bubble-free onto the printing cylinder while said substrate passes through the printing gap between the printing cylinder and the contact pressure roller. The GB-PS No. 11 59 923 describes a corresponding printing machine in which a corona wire lying opposite the contact pressure roller is used as electrode arrangement.

The transfer of ink drops from the printing cylinder to the paper is also improved by the electrostatic field applied, since the ink droplets are set in lively motion, fall onto the paper and penetrate into it more quickly than is the case with simple surface contact. Due to the electrostatic contact pressure of the substrate, which should not exhibit too high a dielectric constant, the quality of the printing process can be improved and also a speeding up of the same can be achieved. It is however almost impossible to put these advantages into effect, since in cases of unavoidable tearing of the substrate during operation the high corona charge necessary for efficient working leads to the formation of spark discharges, which ignite the explosive mixture of air and printing ink solvents surrounding the printing machine and thus trigger off an explosion. Despite many attempts this problem has not yet been solved satisfactorily enough to meet the requirements set by the corresponding supervisory authorities for the industrial use of such printing machines being provided with electrostatic substrate pressure devices.

SUMMARY OF THE INVENTION

It is the object of the invention to provide a method as described at the beginning for electrostatic assistance in printing processes, so that improved printing results are obtained and whereby the danger of an explosion taking place in the case of a tear in the paper or in the presence of highly explosive mixtures, where spark formation could lead to an ignition of these mixtures, is prevented. In addition the invention provides a corresponding printing machine.

It is a further object of the invention to provide improved safety for the machine operators and to provide a printing process and a printing machine whereby operation is simple and inexpensive.

The above objects are reached according to the invention by means of a method for electrostatic assistance in printing processes, in which method the danger of an explosion taking place in the case of a tear in the paper or in the presence of highly explosive mixtures, where spark formation could lead to an ignition of these mixtures, is prevented, and a corresponding printing machine, in that the charge carriers required per unit length of the printing gap and per second in order to achieve the desired printing result are sprayed over discrete points distributed along the contact pressure roller and being acted upon by a d.c. voltage, in which process the current flowing to the individual points or to discrete groups of points is decoupled and the current flowing through each point in the case of a short circuit is limited to a value which is less than the critical breakdown current for the respective atmosphere.

PREFERRED EMBODIMENTS OF THE INVENTION

The decoupling can be effected by the electricity being supplied separately to the individual point electrodes or discrete groups of electrodes, which is, however, expensive. It is easier to use very high-resistance external series resistors.

Under break-down current is meant here that current being associated with the formation of sparks but which in the respective explosive atmosphere of air and solvent does not yet suffice to ignite the explosive gas mixture.

The invention is based on the fact that the spark triggering off an explosion does not form between the contact pressure roller and the printing cylinder in the case of a tear in the paper. The spark is much more likely to arise at the point electrodes, should the torn substrate or parts of same get between the point electrodes and the contact pressure roller, and if the substrate gets wrapped around the contact pressure roller. A dielectric is thus introduced into the gap between the points and the contact pressure roller, and this raises the capacity of the system formed by the electrode arrangement and the contact pressure roller. Due to the relation $$Q=C\times U,$$

the charge at first increases. This effect is superimposed on the corona discharge. Without any current limitation at the individual points, high-energy spark discharge from the point to the contact pressure roller results, which discharge ignites the explosive mixture. The short circuit current flowing in the case of spark discharge from a point is expediently limited to current intensities below 400 $\mu$A, preferably below 250 $\mu$A. Whilst the points are being sprayed the current flowing through the individual points is expediently limited to about 2 to about 20 $\mu$A, preferably about 10 to about 15 $\mu$A. It is preferable to spray the electrons and ions evenly over that length of the contact pressure roller which corresponds to the width of the strip of substrate to be printed in each case and being passed between contact pressure roller and printing cylinder. It is advisable to keep the surroundings of the points, except in the case of the contact pressure roller, free of conducting materials onto which the electrons and ions could flow.

A printing machine according to the invention, having electrostatic substrate contact pressure and being particularly suitable for carrying out the previously-described procedure, and which is provided both with a conductive printing cylinder for the transfer of the printing ink, as in the conventional printing machines being equipped with electrostatic substrate contact pressure, and with the means to feed in a substrate to be printed with the printing ink on the printing cylinder, and with a contact pressure roller which is provided with a non-conductive or weakly-conductive outer layer, said roller pressing the printing substrate mechanically against a surface section of the printing cylinder, where in this case at least one electrode arrangement lying longitudinal to the contact pressure roller serves for the electrostatic substrate contact pressure, which electrode arrangement sprays electrons and ions by corona discharge onto the contact pressure roller lying opposite when a high voltage is applied between the printing cylinder and the electrode arrangement, is characterized according to the invention in that every electrodè arrangement consists of a unit of non-conductive material in which discrete point electrodes, being connected to a d.c. current source, are embedded in such a way that only their free points project out and that the current supply to the point electrodes is decoupled at least for different discrete subgroups of point electrodes, where in each of the subgroups the maximum current flowing through one of the points in the case of a short circuit is limited to a value which is less than the critical break-down current for the respective atmosphere.

A printing machine having electrostatic substrate contact pressure is known from the DT-OS No. 21 10 199, where the contact pressure roller is charged by means of a so-called corotron, this being positioned along the contact pressure roller. The corotron consists of a conductive casing being provided with a longitudinal opening and having spray electrodes attached in its interior, the spray electrodes being insulated from same; when a high voltage is applied between the spray electrodes and the casing, the electrodes produce a corona discharge developing between casing and electrodes. The electron flow leaving the spray electrodes flows in this case directly to the casing. In order to avoid a spark discharge to the exterior, the exit opening is covered with a screen being conductively connected to the casing. This does not, however, as is expressly apparant from these documents, avoid flashing over of sparks in the interior of the corotron. Operation of the corotron with a.c. current does lead to a quick extinguishing of the sparks formed in each case. These measures are however insufficient to prevent the ignition of gas mixtures in the X-regions surrounding the printing machine, which mixtures, as a result of thermal currents and the uncontrollable formation of air whirls, get into the interior of the corotron and can be ignited there. Since in order to obtain a notable improvement in the printing results $10^{13}$ charge carriers must flow per second in the printing gap over a length of some 20 mm magnitude—which corresponds to a current of some 10 $\mu$A—the corotron must, if it is to effectively assist the printing process, supply these charge carriers to the contact pressure roller. As the flow of electrons moving from the discharge electrodes to the casing during the corona discharge cannot be used for charging the contact pressure roller, there are in the case of operation with a.c. current only the ions with one sort of charge, which are produced in the corotron by impact ionization, available for this. In relation to the flow of electrons, the proportion of these charge carriers amounts to some mere 20 to 30%. Of these ions only those which, as a result of the penetration factor and the flow of ions, manage to get out of the corotron can be used for charging the contact pressure roller. In relation to the total number of ions produced in the corotron this amounts, even in the case of good geometry, to a maximum of only 80%. If, however, as suggested in the DT-OS No. 21 10 199, the interior of the corotron is rinsed through with air or steam, which should hinder the formation of sparks, hardly any ions reach the contact pressure roller, since in this case the effect of the flow of ions, which effect is the most important with regard to the transport of charge, is cancelled. Since therefore only a small fraction of the total charge carriers produced in the corotron can be effectively used for the printing process, a very high current density is necessary for the corona discharge. The current density in the corotron cannot therefore be limited to such an extent that explosive sparks are avoided.

The version of spray electrode given in an embodiment of the DT-OS No. 21 10 199 as a series of point electrodes, which are protected by resistance means from being fed an excessively strong current, could not count as being obvious to the teaching of the invention since these resistances only represent a portection against accidental physiologically harmful current surges, but with respect to the danger of explosion do not guarantee any effective reduction in the current density.

In contrast to this, the method and the printing machine according to the invention enable a limitation of the current below the critical break-down current for the respective atmosphere, since a current density 6 to 10× lower is sufficient here. Besides the increased safety this naturally provides an economic advantage too.

In the printing machine according to the invention each point electrode of the electrode arrangement is preferably decoupled with respect to the current supply from all other point electrodes. If, however, the difference between the short circuit current and the critical current permits, two or more point electrodes can also be combined with respect to the current supply.

According to a particularly preferred embodiment each electrode arrangement has at least one distributing bar connected with low resistance, eg. ($R<0.1\Omega$) to the d.c. source, the individual point electrodes or discrete subgroups of points being attached to said distributing bar. The resistance offered by the individual external series resistors is expediently about 1.5 to 5 times, preferably about 1.8 to 3.2 times the internal resistance $R_I$ exhibited by the electrode arrangement in the case of a short circuit without the external series resistors. The resistance offered by the external series resistors is expediently between 50 and about 150 M$\Omega$, preferably between about 75 to about 100 M$\Omega$, the latter especially for the case of there being an air-toluol mixture surrounding the printing machine.

It is useful if all point electrodes and external series resistors are equally dimensioned, with the free ends of the points lying in one plane.

According to a particularly useful version of the invention the point electrodes are arranged equidistant from one another and/or along a straight line, preferably so that they lie transversely to the contact pressure roller.

It is particularly favourable if the distributing bar, the external series resistors and the point electrodes are so embedded in a non-conductive substance, preferably a casting compound, that only the free ends of the point electrodes project out of this. The free ends of the point electrodes can then be attached in a familiar way, inset in a groove in the electrode unit formed from the non-conductive substance.

The development of the electrode arrangement as according to the invention has the object of limiting the corona current for each point to a non-critical maximum value. The resistance offered by the individual points thus becomes independent of the total number of points in the electrode arrangement. The total current $I_{ges}$ flowing through the distributing bar, the total current comprising the sum of single currents $I_1$ to $I_n$—in the case of n points—can thus be a multiple of the critical current $I_{krit}$.

Whilst with known low-resistance systems the irregular impulses of increased current occurring above the initiating corona and having values of $I=350\ \mu A$ give rise to a large statistical irregularity in the corona discharge, the impulses of increased current are limited in the electrode arrangement according to the invention, due to the set current limitation for each point, to values of 15 to 30 $\mu A$. Besides the added safety with regard to explosions, a better distribution of current to all points is achieved in this way and thus a more uniform field distribution obtained. This must of necessity effect an improvement in the efficiency of the system since the statistical influences of the surrounding field are practically eliminated. With respect to the energy in the field surrounding each point it can be shown that in the case of an increase in the voltage in the electrode system to a value which, as a result of the prevailing electrical field strength, could enable a spark discharge, the energy in the field surrounding the point remains too small, due to the limited current, to ignite the respective solvent-air mixture.

As a result of the high efficiency of the system the number of points can be reduced by some 30% in comparison with conventional systems. The refinement of the point electrodes at their free ends is similarly less critical than in conventional cases, so that there is less dependence on an exact punctiform finish.

A further advantage worth mentioning is that a physiological danger to the operator in the case of accidental contact with the live electrode points is avoided (also when large currents $I_{ges}$ flow).

According to a further development of the invention, the printing machine is provided with at least one shield which is positioned next to the contact pressure roller in such a way as to prevent the strip of substrate or pieces of same getting between the contact pressure roller and the free ends of the point electrodes in the case of a tear in the substrate.

The substrate shield should prevent any penetration of the dielectric between the electrode points and the contact pressure roller and thus exclude any increase in capacity. It is however safer to make use of the electrode arrangement according to the invention, since here, with correct dimensioning, the spark discharge is of such low energy, if not completely prevented, due to the small current being limited by the resistors, that it does not suffice for an ignition even in the explosion regions of danger class 1.

A further danger of triggering off explosions exists when a tear in the substrate necessitates lifting the contact pressure roller. This is generally released automatically by means of a substrate tear switch. If the corona discharge through the electrode arrangement is not completely finished at this time, the contact pressure roller, which was previously earthed via the printing cylinder, is charged up rapidly to a considerable extent and sparkovers between its surface and the mounting or the roller core become possible. In order to avoid this disadvantage a device is proposed according to the invention which prevents excessive charging, through the electrode arrangement, of the contact pressure roller after lifting it from the printing cylinder. The device consists preferably of a delay circuit which prevents lifting of the contact pressure roller until the corona is cut off. This is expediently effected by means of a delaying protective relay connected between the substrate tear switch and a protection device for the contact pressure roller lifting mechanism. It is also possible to provide a conductive, earthed slider, which is brought into contact with the contact pressure roller either before or directly after lifting the contact pressure roller from the printing cylinder.

The accompanying drawings of an example serve for further explanation of the invention.

FIG. 2 shows a schematic view of an electrode arrangement according to the invention.

FIG. 3 shows in perspective a part-view of a section of the electrode arrangement according to the invention.

FIG. 4 is a diagram from which the operating point of the electrode arrangement according to the invention can be seen.

Figure 1:
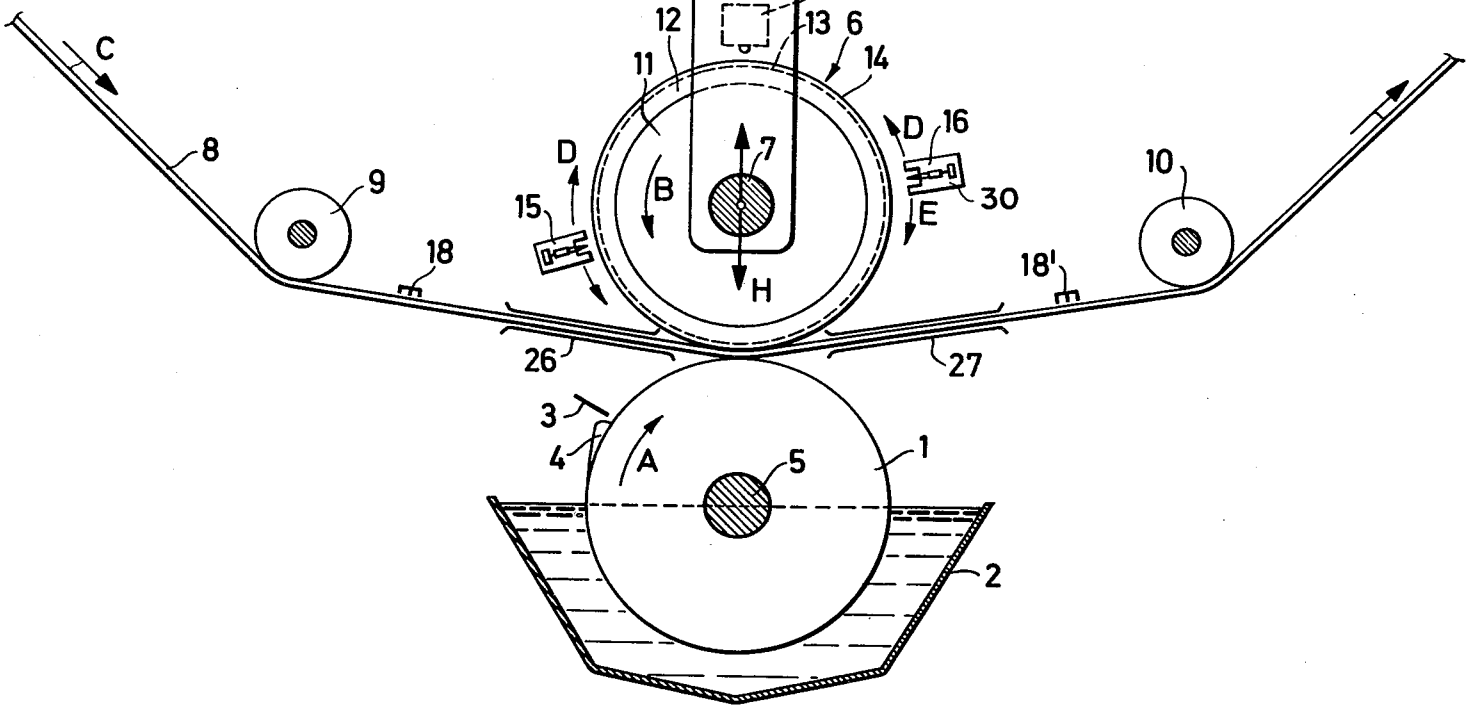
FIG. 1 shows a schematic view of a printer as in a printing machine according to the invention.

FIG. 1 shows a printing cylinder 1 dipping into an ink bath 2 by which means the surface of the printing cylinder is provided with printing ink. The printing cylinder has an arrangement of prominences and indentations corresponding to the pattern to be printed, the printing ink to be transferred to the printing substrate being carried in the indentations. Excess ink 4 is removed from the surface of the printing cylinder by a ductor 3. The printing cylinder is mounted on a shaft 5 which is set in rotation by a driving device not shown in such a way that the printing cylinder rotates for example in the direction of arrow A. The machine can also be driven in the other rotational direction of the printing cylinder, as is mentioned again later.

A contact pressure roller 6 is mounted on a shaft 7 and rotates in the direction of arrow B. Running between the printing cylinder 1 and the contact pressure roller 6 there is a belt-like strip of printing medium or substrate 8, consisting of a dielectric material and being wound off in the direction of arrow C from a supply roll, provided for example on the left side of the picture but not shown, then over a first deviating roller 9 and then between the printing cylinder 1 and the contact pressure roller 6. From there the strip of substrate runs over a second deviation roller 10 either onto an identical or similar printer on the right side of the picture for another printing ink, or onto a rolling-up or processing device, not shown, where the now printed strip of substrate is stored or further processed.

The contact pressure roller 6 preferably has a metallic core 11 on whose surface a coat 12 of electrically non-conductive material with a high dielectric constant is provided. "Rilsan" is a material of this sort. The high dielectric constant is necessary in order to keep the flow of electrostatic charge off onto the normally-earthed core 11 of the contact pressure roller 6 as small as possible. A layer 13 of weakly-conductive material, shown with a broken line, is provided on the coat 12 of dielectric material and adheres closely to the surface of same. Rubber, for eg., with a relatively high addition of carbon black, can serve as such a material. Another carrier material for electrically conductive particles can also be used, eg. also metallic powder, in place of rubber. The electrically conductive layer 13 is covered by a layer 14 of abrasion-proof, elastic material whose electrical conductivity is somewhat less than that of layer 13, but which need not necessarily be a dielectric material. The layers 13 and 14 are preferably connected together in one piece so as to avoid any loosening or detachment of the layers during operation. Since the covering layer 14 has essentially the function of a protective layer against excess abrasion, it is in principle possible to do without the additional covering layer by using a material being well resistant to abrasion and being of high elasticity for the electrically conductive layer 13.

With regard to the induction device used for producing the electrostatic field effective between the printing cylinder 1 and the contact pressure roller 6, only the electrode arrangement 15,16 is shown, this being described in more detail with the help of FIGS. 2 and 3. Every electrode arrangement is expediently provided with means, not shown, by which the electrode arrangement can be swung concentric to the surface of the contact pressure roller 6 in the direction of the arrows D,E, and can also be adjusted in a radial direction in order to set the optimal distance between the surface of the roller and the electrodes. In practice this distance is about 30 mm. The set-up with two electrode arrangements 15,16 is advisable for two reasons: firstly the direction in which the strip of substrate 8 runs through can be arbitrarily decided on, and secondly, depending on the type and dielectric constant of the substrate material, the rate of working, the desired application of ink etc., it is useful to be able to apply the voltage to one or the other electrode arrangement.

In addition an ionizer 18 is provided opposite the strip of substrate, the ionizer being positioned, when operation is in the direction given by arrow C, between the deviation roller 9 and the contact pressure roller 6. When the strip of substrate is running in the reverse direction an ionizer 18' is provided, being positioned laterally reversed with respect to the printing gap. The ionizers 18 and 18' effect a conductive discharge in so far as the strip of substrate is already charged, ensuring that the field distribution is as uniform as possible while printing.

In order to prevent pieces of the substrate getting wrapped around the contact pressure roller 6 and between the electrode arrangements 15 or 16 and the contact pressure roller 6 in the case of a tear in the substrate, substrate shielding devices 26 and 27 are positioned close to the contact pressure roller 6. The strip of substrate passes through these. When there is a tear in the substrate a substrate tear switch, not shown in the drawing, actuates a mechanism indicated only by the reference number 29 for raising the contact pressure roller. The contact pressure roller 6 is thereby moved away from the printing cylinder 1 in the direction of arrow H. After lifting, the charges transferred from the electrode arrangements 15 or 16 onto the contact pressure roller are no longer carried off via the earthed printing cylinder 1. This means that there is increased charging of the contact pressure roller which can lead to the possibility of high-energy sparking over. This charging up of the contact pressure roller is avoided in that when lifted, its outer surface comes into contact with a conductive, earthed slider 28, via which the charges can be carried off.

FIG. 2 shows a schematic plan of the electrode arrangement 15 and its electrical circuit. The electrode arrangement 15 consists of a non-conductive unit 30 (FIG. 3) comprising preferably a non-conductive casting compound 22, in which a distributing bar 24 having the one pole connected to a supply point is embedded. n-discrete point electrodes, $25_1, 25_2, \ldots 25_n$ are connected via high-resistance external series resistors $R_1, R_2 \ldots R_n$ to the distributing bar 24. The external series resistors and the ends of the point electrodes, being attached only to the resistors, are similarly embedded in the casting compound 22. The anterior ends of the point electrodes project above the casting compound 22.

During operation the electrode arrangement is connected to the insulated pole (plus or minus) of a high-tension d.c. supply.

FIG. 3 shows a concrete example for the electrode arrangement 15 or 16. It can be seen that the free ends of the point electrodes $25_1, 25_2 \ldots$ open into a groove 23 which is sunk into a lateral surface of the electrode unit, the latter being formed of the casting compound 22 and being of rectangular cross section in the case shown. The free points are approximately flush with the upper edge of the electrode unit. The point electrodes are arranged along a straight line in the electrode arrangement and are equidistant from one another. In practice the distance between electrodes is about 10–30 mm, preferably about 20 mm. The distance at which the electrode arrangements 15,16 are held from the contact pressure roller 6 is about 15 to 30 mm. The rate at which the strip of substrate 8 passes through the printing gap goes up to about 14 m/sec in practice.

The distributing bar 24 is, as with the familiar linear corona electrodes, connected to the power supply with low electrical resistance (R 0.1). The electrode system exhibits optimal efficiency when the voltage applied, and thus the prevailing electrical field intensity, do not permit sparking over. The operating point, as dependent on current and voltage, is shown in FIG. 4.

The short circuit current of 1 mA flowing normally in the case of an electrode arrangement without external series resistors is reduced by the series resistors in the electrode arrangement according to the invention to average values of 200 $\mu$A$\pm$100 $\mu$A.

EXAMPLE

Terminal voltage of high-voltage generator $U_{k\,max}=30$ KV with no-load current.

Short circuit current without resistance in the point $I_k$ $$I_k = 1\text{mA} \rightarrow R_j = 30\ M\Omega$$

This total current suffices in the case of sparking over to ignite a mixture of toluol and air. When using the external series resistors of eg. $R_v=100$ M$\Omega$ in each point, the maximum current per point is calculated as:

$$I_{max} = \frac{U_{k\,max}}{R_t + R_v} = \frac{3 \cdot 10^4 V}{1{,}3 \cdot 10^8 \Omega} = 231\ \mu A$$

When the current is limited to this value the energy in the case of sparking over is reduced to about 1/16, which no longer suffices to ignite the mixture of air and solvent.

We claim:

1. Method for electrostatic assistance of the printing process in a printing machine, in which method a non-conductive printing substrate is passed between a printing cylinder coated with printing ink and a contact pressure roller which mechanically presses the substrate against the cylinder and which is provided with an outer layer of material selected from the group consisting of non-conductive and weakly-conductive materials, during which procedure the application of a high d.c. voltage between the printing cylinder and at least one of a plurality of point electrodes running in a longitudinal direction to the contact pressure roller results in electrons and ions being sprayed by corona discharge onto the surface of the contact pressure roller which, as a result of its rotating and its intrinsic conductivity, conveys these electrons and ions into the printing gap and enables them to flow off over this gap, characterized by spraying the electrons and ions required per unit length of the printing gap and per second in order to achieve the desired printing result over the discrete electrode points distributed along the contact pressure roller and being acted upon by said d.c. voltage, in which process the current flowing to discrete groups of said electrode points is decoupled, and the current flowing through each electrode point in the case of a short circuit, is limited to a value which is less than the critical break-down current for the atomsphere surrounding said machine.

2. Method according to claim 1, characterized in that the short-circuit current flowing through a point in the case of a spark discharge is limited to current intensities of less than 400 $\mu$A.

3. Method according to claim 1, characterized in that the current flowing through the individual points during spraying is limited to about 2 to about 20 $\mu$A.

4. Method according to claim 1 further characterized in that the current flowing to individual ones of the electrode points is decoupled.

5. Method according to claim 1, or 4 characterized in that the short-circuit current flowing through a point in the case of a spark discharge is limited to current intensities of less than 250 $\mu$A.

6. Method according to claim 1, or 4 characterized in that the current flowing through the individual points during spraying is limited to about 10 to about 15 $\mu$A.

7. Method according to claims 1 or 2, or 4, characterized by spraying the electrons and ions evenly over that length of the contact pressure roller which corresponds to the width of the strip of substrate to be printed in each case and being passed between contact pressure roller and printing cylinder.

8. Method according to claims 1, or 2 or 3 or 4, characterized by keeping the surroundings of the points, except in the case of the contact pressure roller, free of conducting materials onto which the electrons and/or ions could flow.

9. Printing machine with electrostatic assistance of printing substrate contact pressure, with a conductive printing cylinder for the transfer of printing ink, with a means to feed in a substrate to be printed with the printing ink on the printing cylinder, with a contact pressure roller being provided with an outer layer of a material selected from the group consisting of non-conductive and weakly-conductive materials, said roller pressing the printing substrate mechanically against a surface section of the printing cylinder, and with at least one electrode arrangement lying longitudinal to the contact pressure roller and providing the electrostatic substrate contact pressure, which electrode arrangement sprays electrons and ions by corona discharge onto the contact pressure roller surface lying opposite the electrode arrangement when a high d.c. voltage is applied between the printing cylinder and the electrode arrangement, characterized in that each electrode arrangement consists of: a unit of non-conductive material, in which discrete point electrodes, being connected to a d.c. current source providing said high voltage, are embedded in such a way that only their free points project out; and resistor means for decoupling the current supply from the point electrodes at least for different discrete subgroups of point electrodes, where in each of the subgroups the maximum current flowing through one of the points in the case of a short circuit is limited to a value which is less than the critical break-down current for the atmosphere surrounding the machine.

10. Printing machine according to claim 9 wherein the number of point electrodes in each of said discrete groups is one.

11. Printing machine according to claim 9, characterized in that the maximum current flowing through a point is limited to about 10 to about 30% of the short-circuit current that would flow if there were no decoupling or current limitation.

12. Printing machine according to claims 9 or 11 further comprising individual resistor means connected in series with each point electrode for decoupling each point electrode of the electrode arrangement with respect to the current supply from all other point electrodes.

13. Printing machine according to claim 9 characterized in that each electrode arrangement (15,16) has at least one distributing bar (24), embedded in the non-conductive material and being connected with low resistance to the d.c. source, to which the discrete subgroups of point electrodes are connected via high-resistance external series resistors ($R_1 \ldots R_n$).

14. Printing machine according to claim 12 in which the number of point electrodes in each discrete subgroup is one.

15. Printing machine according to claim 13, characterized by the resistance of the individual external series resistors ($R_1 \ldots R_n$) being about 1.5 to about 5 times the resistance exhibited by the electrode arrangement (15,16) in the case of a short circuit without the external series resistors.

16. Printing machine according to claim 13 characterized by the external series resistors ($R_1 \ldots R_n$) having resistance values of about 50 to about 150 M$\Omega$.

17. Printing machine according to 13, 10 or 16 characterized by all point electrodes ($25_1 \ldots 25_n$) and external series resistors being equally spaced apart and by the free ends of the point electrodes lying in one plane.

18. Printing machine according to claims 13 or 15 or 14 characterized by the point electrodes ($25_1 \ldots 25_n$) being arranged equidistant from one another and along a straight line, so that they lie transversely to the contact pressure roller (6).

19. Printing machine according to claims 9 or 13 or 14 characterized by the free ends of the point electrodes being attached inset in a groove (23) in the electrode unit formed from the non-conductive material (22).

20. Printing machine according to claim 9 characterized by having at least one shield positioned insuch a way next to the contact pressure roller as to prevent the substrate or pieces of same getting between the contact pressure roller and the electrode arrangement in the case of a tear in the substrate.

21. Printing machine with an electrostatic assistance of substrate contact pressure, with a conductive printing cylinder for the transfer of printing ink, with means to feed in a substrate to be printed with the printing ink on the printing cylinder, with a contact pressure roller which is provided with an outer layer of a material selected from the group consisting of non-conductive and weakly-conductive materials, said roller pressing the printing substrate mechanically against a surface section of the printing cylinder, and with at least one electrode arrangement lying longitudinal to the contact pressure roller for providing the electrostatic assistance, which electrode arrangement sprays electrons and ions by corona discharge onto the contact pressure roller lying opposite the electrode arrangement when a high voltage is applied between the printing cylinder and the electrode arrangement, characterized by having at least one shield positioned in such a way next to the contact pressure roller as to prevent the substrate or pieces of same from getting between the contact pressure roller and the electrode arrangement in case of a tear in the substrate.

22. Printing machine according to claim 9 or 10, characterized in that the maximum current flowing through a point is limited to about 15 to about 25% of the short-circuit current that would flow if there were no decoupling or current limitation.

23. Printing machine according to claim 13 or 14, characterized by the resistance of the individual external series resistors ($R_1 \ldots R_n$) being about 1.8 to about 3.2 times the resistance exhibited by the electrode arrangement (15,16) in the case of a short circuit without the external series resistors.

24. Printing machine according to claim 13 or 14, characterized by the external series resistors ($R_1 \ldots R_n$) having resistance values of about 75 to about 100 MΩ.

25. Printing machine according to claim 9 or 21 characterized by a device (28) which prevents excessive charging, through the electrode arrangement, of the contact pressure roller after lifting it from the printing cylinder.

26. Printing machine with electrostatic assistance of substrate contact pressure, with a conductive printing cylinder for the transfer of printing ink, with means to feed in the substrate to be printed with the printing ink on the printing cylinder, with a contact pressure roller being provided with an outer layer of a material selected from the group consisting of non-conductive and weakly-conductive materials, said roller pressing the printing substrate mechanically against a surface section of the printing cylinder, with at least one electrode arrangement lying longitudinally to the contact pressure roller for providing the electrostatic assistance, which electrode arrangement sprays electrons and ions by corona discharge onto the contact pressure roller lying opposite the electrode arrangement when a high voltage is applied between the printing cylinder and the electrode arrangement, and with a mechanism for lifting the contact pressure roller in order to thread the substrate between the contact pressure roller and printing cylinder, characterized by a device which prevents excessive charging, through the electrode arrangement, of the contact pressure roller after lifting it from the printing cylinder, which excessive charging would cause spark-over.

27. Printing machine according to claim 26, characterized in that the device consists of a delay circuit which prevents lifting of the contact pressure roller until the corona is cut off.

28. Printing machine according to claim 27, characterized in that the delay circuit consists of a delaying protective relay connected between the substrate tear switch and a protection device for the contact pressure roller lifting mechanism.

29. Printing machine according to claim 26, characterized in that the device consists of a conductive, earthed slider (28), which is brought into contact with the contact pressure roller at about the time of the lifting of the contact pressure roller from the printing cylinder.

* * * * *

UNITED STATES PATENT AND TRADEMARK OFFICE

CERTIFICATE OF CORRECTION

PATENT NO. : B1 4,208,965

DATED : January 10, 1984

INVENTOR(S) : HELMUT EICHLER ET AL

It is certified that error appears in the above-identified patent and that said Letters Patent is hereby corrected as shown below:

In line item [45], the "Certificate Issued" date should read --Jan. 10, 1984--.

Signed and Sealed this

*Thirty-first* Day of *July 1984*

[SEAL]

*Attest:*

GERALD J. MOSSINGHOFF

*Attesting Officer*

*Commissioner of Patents and Trademarks*

REEXAMINATION CERTIFICATE (154th)

United States Patent [19] [11] B1 4,208,965

Eichler et al. [45] Certificate Issued Jan. 10, 1983

[54] METHOD FOR ELECTROSTATIC ASSISTANCE IN PRINTING PROCESSES, AND PRINTING MACHINES HAVING ELECTROSTATIC SUBSTRATE CONTACT PRESSURE

[76] Inventors: Helmut Eichler, Burgunderstr. 13, D-7601 Durbach; Franz Knopf, Meister-Erwinstr. 18a, D-758 Bühl, both of Fed. Rep. of Germany

Reexamination Request:
No. 90/000,022, Jun. 30, 1982

Reexamination Certificate for:

| | |
|---|---|
| Patent No.: | **4,208,965** |
| Issued: | **Jun. 24, 1980** |
| Appl. No.: | **889,801** |
| Filed: | **Mar. 24, 1978** |

[30] Foreign Application Priority Data

Mar. 25, 1977 [DE] Fed. Rep. of Germany ..... 2713334
Apr. 7, 1977 [DE] Fed. Rep. of Germany ..... 2715766

[51] Int. Cl.[3] ..... B41F 5/04; G05F 1/00
[52] U.S. Cl. ..... 101/426; 101/153; 101/DIG. 13; 346/155; 346/3 R; 250/324; 315/307; 361/229
[58] Field of Search ..... 101/426, 170, 153; 346/153.1, 155; 361/229, 225, 230, 235; 250/324, 325, 326; 226/11

[56] References Cited

U.S. PATENT DOCUMENTS

| | | | |
|---|---|---|---|
| 3,083,121 | 3/1963 | Gauthier | 101/DIG. 13 |
| 3,137,806 | 6/1964 | Schweriner | 317/2 |
| 3,295,441 | 1/1967 | Garnier | 101/DIG. 13 |
| 3,340,429 | 9/1967 | Owens | 361/229 |
| 3,370,200 | 2/1968 | Heyl et al. | 250/326 X |
| 3,370,529 | 2/1968 | Michalchik | 101/DIG. 13 |
| 3,404,627 | 10/1968 | Halley | 101/228 |
| 3,411,932 | 11/1968 | Malone et al. | 118/652 |
| 3,477,369 | 11/1969 | Adamson et al. | 101/170 |
| 3,489,895 | 1/1970 | Hollberg | 250/324 |

(List continued on next page.)

FOREIGN PATENT DOCUMENTS

| | | |
|---|---|---|
| 1611204 | 11/1967 | Fed. Rep. of Germany . |
| 574176 | 3/1976 | Switzerland . |
| 575670 | 5/1976 | Switzerland . |
| 1159923 | 7/1969 | United Kingdom . |
| 1349342 | 4/1974 | United Kingdom . |

OTHER PUBLICATIONS

Jaspert, "A New Electrostatic Assist System", *Package Printing and Diecutting*, May 1976.

Helmut Eichler, Heliofurn 35 System (Test Report from the Plant and Development Laboratory of BURDA GmbH dated May 1976) in German, with translation.

Report of the Physikalisch-Technische Bunde sanstalt-No. 3.41-6385/70 (Federal Material Testing Laboratories Report on Electrostatic Hand Spray System)-in German, with translation.

H. Fierz, Untersuchungen an Ionisatoren (Swiss Federal Material and Test Laboratories Report 1973-Tests with Ionizers)-in German, with translation.

*Primary Examiner*—E. H. Eickholt

[57] ABSTRACT

A method for electrostatic assistance of the printing process in printing machines, in which method a printing substrate, being of a material which is not electrically conductive, is passed between a printing cylinder coated with printing ink and a contact pressure roller which mechanically presses the substrate against the cylinder and which is provided with a non-conductive or weakly-conductive outer layer, during which procedure the application of a high voltage between the printing cylinder and at least one of the electrode arrangements running in a longitudinal direction to the contact pressure roller results in electrons and ions being sprayed by corona discharge onto the surface of the contact pressure roller, which, as a result of its rotating and/or its intrinsic conductivity conveys these charged particles into the printing gap and enables them to flow off over this gap, and also a corresponding printing machine.

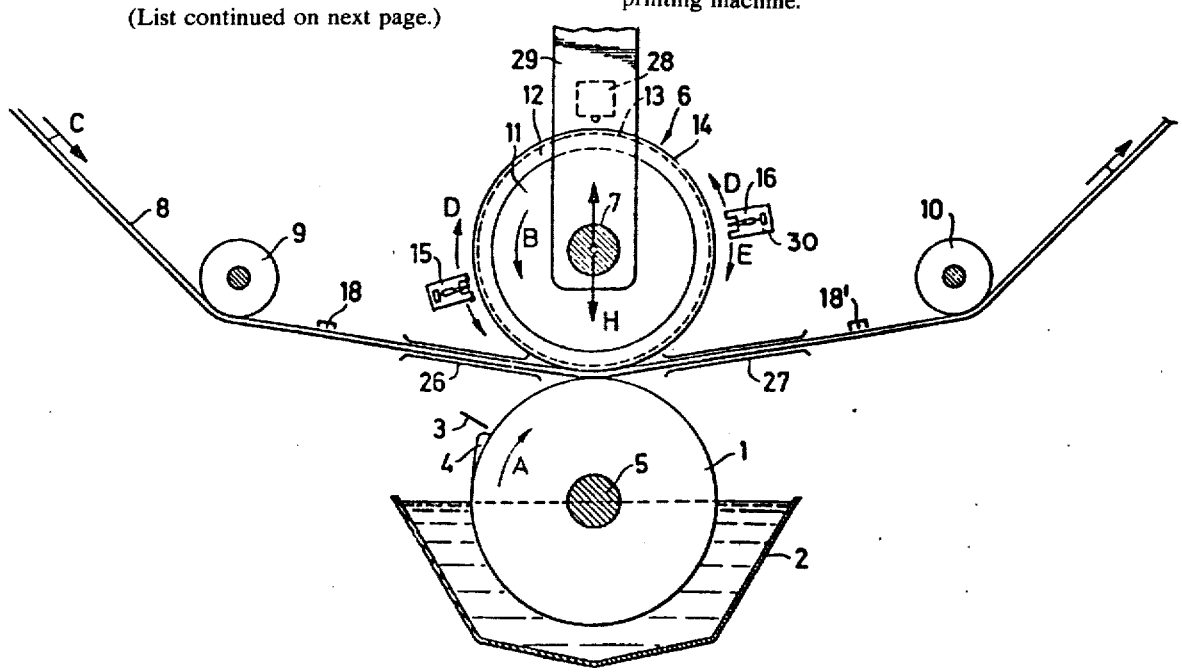

U.S. PATENT DOCUMENTS

| | | | |
|---|---|---|---|
| 3,604,925 | 9/1971 | Snelling | 315/291 X |
| 3,619,720 | 11/1971 | Coberley | 317/3 |
| 3,623,123 | 11/1971 | Jvirblis | 101/DIG. 13 X |
| 3,661,081 | 5/1972 | Wright | 101/426 |
| 3,699,388 | 10/1972 | Ukai | 361/229 |
| 3,764,883 | 10/1973 | Staad et al. | 250/324 |
| 3,795,839 | 3/1974 | Walberg | 361/235 X |
| 3,797,927 | 3/1974 | Takahashi et al. | 250/325 X |
| 3,812,780 | 5/1974 | Boreli | 101/216 |
| 3,875,461 | 4/1975 | Richardson et al. | 361/230 |
| 3,896,451 | 7/1975 | Omi | 226/11 |
| 3,900,735 | 8/1975 | Jahn | 361/229 |
| 3,928,844 | 12/1975 | Melhofer | 226/11 |
| 3,936,184 | 2/1976 | Tanaka et al. | 250/325 X |
| 3,943,501 | 3/1976 | Kulka et al. | 361/235 X |
| 4,016,455 | 4/1977 | Christiansen | 361/222 |
| 4,105,320 | 8/1978 | Bean | 335/3 TR |

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 24–68:
Column 4, lines 1–13:

A printing machine having electrostatic substrate contact pressure is known from the DT-OS No. 21 10 199, where [the contact pressure roller is charged] *it is intended to charge the contact pressure roller* by means of a so-called corotron, this being positioned along the contact pressure roller. The corotron consists of a conductive casing being provided with a longitudinal opening and having spray electrodes attached in its interior, the spray electrodes being insulated from same; when a high voltage is applied between the spray electrodes and the casing, the electrodes produce a corona discharge developing between casing and electrodes. The electron flow leaving the spray electrodes flows in this case directly to the casing. In order to avoid a spark discharge to the exterior, the exit opening is covered with a screen being conductively connected to the casing. This does not, however, as is expressly apparent from these documents, avoid flashing over of sparks in the interior of the corotron. Operation of the corotron with a.c. current does lead to a quick extinguishing of the sparks formed in each case. These measures are however insufficient to prevent the ignition of gas mixtures in the X-regions surrounding the printing machine, which mixtures, as a result of thermal currents and the uncontrollable formation of air whirls, get into the interior of the corotron and can be ignited there. Since in order to obtain a notable improvement in the printing results $10^{13}$ charge carriers must flow per second in the printing gap over a length of some 20 mm magnitude—which corresponds to a current of some 10 $\mu$A—the corotron must, if it is to effectively assist the printing process, supply these charge carriers to the contact pressure roller. As the flow of electrons moving from the discharge electrodes to the casing during the corona discharge cannot be used for charging the contact pressure roller, there are in the case of operation with a.c. current only the ions with one sort of charge, which are produced in the corotron by impact ionization, available for this. In relation to the flow of electrons, the proportion of these charge carriers amounts to some mere 20 to 30%. Of these ions only those which, as a result of the penetration factor and the flow of ions, manage to get out of the corotron can be used for charging the contact pressure roller. In relation to the total number of ions produced in the corotron this amounts, even in the case of good geometry, to a maximum of only 80%. If, however, as suggested in the DT-OS No. 21 10 199, the interior of the corotron is rinsed through with air or steam, which should hinder the formation of sparks, hardly any ions reach the contact pressure roller, since in this case the effect of the flow of ions, which effect is the most important with regard to the transport of charge, is cancelled. Since therefore only a small fraction of the total charge carriers produced in the corotron can be effectively used for the printing process, a very high current density is necessary for the corona discharge. The current density in the corotron cannot therefore be limited to such an extend that explosive sparks are avoided.

AS A RESULT OF REEXAMINATION, IT HAS BEEN DETERMINED THAT:

Claims 8, 13, and 15, having been finally determined to be unpatentable, are cancelled.

Claims 1, 9, 16–19, 21, 23, 24 and 26 are determined to be patentable as amended:

Claims 2–7, 10–12, 14, 20, 22, 25, and 27–29, dependent on amended claims, are determined to be patentable.

New claims 30–33 are added and determined to be patentable.

1. Method for electrostatic assistance of the printing process in a printing machine, in which method a non-conductive printing substrate is passed between a printing cylinder coated with printing ink and a contact pressure roller which mechanically presses the substrate against the cylinder and which is provided with an outer layer of material selected from the group consisting of non-conductive and weakly-conductive materials, during which procedure the application of a high d.c. voltage between the printing cylinder and at least one [of a plurality of point electrodes] *electrode arrangement* running in a longitudinal direction to the contact pressure roller results in electrons and ions being sprayed by corona discharge onto the surface of the contact pressure roller which, as a result of its rotating and its intrinsic conductivity, conveys these electrons and ions into the printing gap and enables them to flow off over this gap, characterized by *providing the electrode arrangement with a plurality of discrete electrode points longitudinally thereof, and* spraying the electrons and ions required per unit length of the printing gap and per second in order to achieve the desired printing result over the discrete electrode points distributed along the contact pressure roller and being acted upon by said d.c. voltage, in which process the current flowing to discrete groups of said electrode points is decoupled, and the current flowing through each electrode point in the case of a short circuit, is limited to a value which is less than the critical break-down current for the *atmosphere* [atomsphere] surrounding said machine, *and by keeping the surroundings of the points, except in the case of the contact pressure roller, free of conducting materials onto which the electrons and/or ions could flow.*

9. Printing machine with electrostatic assistance of printing substrate contact pressure, with a conductive printing cylinder for the transfer of printing ink, with a means to feed in a substrate to be printed with the printing ink on the printing cylinder, with a contact pressure roller being provided with an outer layer of a material selected from the group consisting of non-conductive and weakly-conductive materials, said roller pressing the printing substrate mechanically against a surface section of the printing cylinder, and with at least one electrode arrangement lying longitudinal to the contact pressure roller and providing the electrostatic substrate contact pressure, which electrode arrangement sprays electrons and ions by corona discharge onto the contact pressure roller surface lying opposite the electrode arrangement when a high d.c. voltage is applied between the printing cylinder and the electrode arrangement, characterized in that each electrode arrangement *(15,16) consists of a unit of non-conductive material (22) in which are embedded at least one distributing bar (24) connected with low resistance to a direct current source and discrete point electrodes* ($25_1 \ldots 25_n$) *connected with the distributing bar (24), the free points of the electrodes projecting from the surface of the non-conductive material (22), and resistor means for decoupling the current source from the point electrodes at least for different discrete subgroups of the point electrodes, said resistor means comprising high resistance external series resistors* ($R_1 \ldots R_n$) *via which said discrete subgroups of the point electrodes are connected to the distributing bar (24), the resistance of the individual external series resistors* ($R_1 \ldots R_n$) *being about 1.5 to about 5 times the resistance exhibited by the electrode arrangement (15,16) in the case of a short circuit without the external series resistors so that in each subgroup the maximum current flowing through one of the points in the case of a short circuit is limited to a value which is less than the critical break-down current for the atmosphere surrounding the machine.* [consists of: a unit of non-conductive material, in which discrete point electrodes, being connected to a d.c. current source providing said high voltage, are embedded in such a way that only their free points project out; and resistor means for decoupling the current supply from the point electrodes at least for different discrete subgroups of point electrodes, where in each of the subgroups the maximum current flowing through one of the points in the case of a short circuit is limited to a value which is less than the critical break-down current for the atmosphere surrounding the machine.]

16. Printing machine according to claim *9* [13] characterized by the external series resistors ($R_1 \ldots R_n$) having resistance values of about 50 to about 150 MΩ.

17. Printing machine according to *claims 9* [13], 10 or 16 characterized by all point electrodes ($25_1 \ldots 25_n$) and external series resistors being equally spaced apart and by the free ends of the point electrodes lying in one plane.

18. Printing machine according to *claim 9* [claims 13 or 15 or 14] characterized by the point electrodes ($25_1 \ldots 25_n$) being arranged equidistant from one another and along a straight line, so that they lie transversely to the contact pressure roller (6).

19. Printing machine according to *claim 9* [claims 9 or 13 or 14] characterized by the free ends of the point electrodes being attached inset in a groove (23) in the electrode unit formed from the non-conductive material (22).

21. Printing machine with an electrostatic assistance of substrate contact pressure, with a conductive printing cylinder for the transfer of printing ink, with means to feed in a substrate to be printed with the printing ink on the printing cylinder, with a contact pressure roller which is provided with an outer layer of a material selected from the group consisting of non-conductive and weakly-conductive materials, said roller pressing the printing substrate mechanically against a surface section of the printing cylinder, and with at least one electrode arrangement lying longitudinal to the contact pressure roller for providing the electrostatic assistance, which electrode arrangement sprays electrons and ions by corona discharge onto the contact pressure roller lying opposite the electrode arrangement when a high voltage is applied between the printing cylinder and the electrode arrangement, characterized *in that each electrode arrangement consists of: a unit of non-conductive material, in which discrete point electrodes, being connected to a d.c. current source providing said high voltage, are embedded in such a way that only their free points project out; and resistor means for decoupling the current supply from the point electrodes at least for different discrete subgroups of point electrodes, where in each of the subgroups the maximum current flowing through one of the points in the case of a short circuit is limited to a value which is less than the critical break-down current for the atmosphere surrounding the machine, and further characterized* by having at least one shield positioned in such a way next to the contact pressure roller as to prevent the substrate or pieces of same from getting between the contact pressure roller and the electrode arrangement in case of a tear in the substrate.

23. Printing machine according to claim *9* [13 or 14], characterized by the resistance of the individual external series resistors ($R_1 \ldots R_n$) being about 1.8 to about 3.2 times the resistance exhibited by the electrode arrangement (15,16) in the case of a short circuit without the external series resistors.

24. Printing machine according to claim *9* [13 or 14], characterized by the external series resistors ($R_1 \ldots R_n$) having resistance values of about 75 to about 100 MΩ.

26. Printing machine with electrostatic assistance of substrate contact pressure, with a conductive printing cylinder for the transfer of printing ink, with means to feed in the substrate to be printed with the printing ink on the printing cylinder, with a contact pressure roller being provided with an outer layer of a material selected from the group consisting of non-conductive and weakly-conductive materials, said roller pressing the printing substrate mechanically against a surface section of the printing cylinder, with at least one electrode arrangement lying longitudinally to the contact pressure roller for providing the electrostatic assistance, which electrode arrangement sprays electrons and ions by corona discharge onto the contact pressure roller lying opposite the electrode arrangement when a high voltage is applied between the printing cylinder and the electrode arrangement, and with a mechanism for lifting the contact pressure roller in order to thread the substrate between the contact pressure roller and printing cylinder, characterized *in that each electrode arrangement consists of: a unit of non-conductive material, in which discrete point electrodes, being connected to a d.c. current source providing said high voltage, are embedded in such a way that only their free points project out; and resistor means for decoupling the current supply from the*

*point electrodes at least for different discrete subgroups of point electrodes, where in each of the subgroups the maximum current flowing through one of the points in the case of a short circuit is limited to a value which is less than the critical break-down current for the atmosphere surrounding the machine, and further characterized* by a device which prevents excessive charging, through the electrode arrangement, of the contact pressure roller after lifting it from the printing cylinder, which excessive charging would cause spark-over.

*30. Printing machine according to claim 14 characterized by the point electrodes ($25_1 \ldots 25_n$) being arranged equidistant from one another and along a straight line, so that they lie transversely to the contact pressure roller (6).*

*31. Printing machine according to claim 14 characterized by the free ends of the point electrodes being attached inset in a groove (23) in the electrode unit formed from the non-conductive material (22).*

*32. Printing machine according to claim 14, characterized by the resistance of the individual external series resistors ($R_1 \ldots R_n$) being about 1.8 to about 3.2 times the resistance exhibited by the electrode arrangement (15,16) in the case of a short circuit without the external series resistors.*

*33. Printing machine according to claim 14, characterized by the external series resistors ($R_1 \ldots R_n$) having resistance values of about 75 to about 100 MΩ.*

* * * * *